US011751685B2

(12) United States Patent
Hall et al.

(10) Patent No.: US 11,751,685 B2
(45) Date of Patent: Sep. 12, 2023

(54) STORAGE SYSTEM WITH UNDER PLATFORM STORAGE

(71) Applicant: Hall Labs LLC, Provo, UT (US)

(72) Inventors: David R. Hall, Provo, UT (US); Douglas Mecham, Provo, UT (US); Scott Skousen, Lehi, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 17/503,948

(22) Filed: Oct. 18, 2021

(65) Prior Publication Data

US 2023/0123547 A1 Apr. 20, 2023

(51) Int. Cl.
*A47B 81/00* (2006.01)
*A47B 51/00* (2006.01)
*A47B 43/00* (2006.01)

(52) U.S. Cl.
CPC ..... *A47B 81/005* (2013.01); *A47B 43/006* (2013.01); *A47B 51/00* (2013.01)

(58) Field of Classification Search
CPC ... A47B 81/005; A47B 43/006; A47B 43/003; A47B 51/00
See application file for complete search history.

(56) References Cited

U.S. PATENT DOCUMENTS 493,596 A * 3/1893 Carter ..... A47B 46/005 211/117
787,277 A * 4/1905 Lamp ..... B66D 3/06 211/117
846,674 A * 3/1907 McLeran ..... A47B 81/005 211/113
983,957 A * 2/1911 Trantham ..... B66D 3/04 254/338
1,066,371 A * 7/1913 Bosworth ..... A47F 5/0892 211/117
1,185,167 A * 5/1916 Bishop ..... A47B 46/005 211/117
1,202,166 A * 10/1916 Corbett ..... A47F 5/0892 211/117
3,945,462 A * 3/1976 Griswold ..... E04G 5/045 248/231.51
D273,446 S * 4/1984 Rankin ..... D7/701
(Continued)

*Primary Examiner* — Stanton L Krycinski

(57) ABSTRACT

A storage system is described, having a rectangular platform adapted to be raised and lowered. The platform includes a top surface configured to support one or more items to be stored, a bottom surface, a first side, and a second side opposite the first side. The system also includes a first bracket, with an upper portion attached to the first side of the platform and a lower portion extending below the bottom surface. The lower portion of this first bracket is shaped in such a way as to provide a first surface on which a portion of an additional item rests. The system also includes a second bracket, likewise with an upper portion attached to the second side of the platform and a lower portion extending below the bottom surface. The lower portion of the second bracket is also shaped in such a way as to provide a second surface on which a portion of the additional item rests. In this way, the first and second brackets cooperate to support the additional item below the platform. In another aspect, the second bracket is replaced with at least one clip.

11 Claims, 11 Drawing Sheets

(56) References Cited

U.S. PATENT DOCUMENTS 5,051,027 A * 9/1991 Horton ..... B63C 3/06 254/338
5,094,351 A * 3/1992 Barney ..... A47B 81/005 224/311
6,056,274 A * 5/2000 Naas ..... B63C 15/00 254/338
6,152,427 A * 11/2000 Hoslett ..... B66C 1/16 254/338
6,386,515 B1 * 5/2002 Sachtleben ..... B66D 1/04 254/338
6,439,405 B1 * 8/2002 Hanneken ..... A47F 5/0892 211/113
6,910,592 B1 * 6/2005 Lindenmeyer ..... A47B 81/005 211/60.1
6,935,600 B1 * 8/2005 Barrepski ..... A47B 96/06 211/113
6,959,918 B1 * 11/2005 Samuels ..... B66D 3/04 254/338
7,165,684 B2 * 1/2007 Ferron ..... B62H 3/12 211/118
D537,771 S * 3/2007 Pflieger ..... D12/406
7,325,785 B2 * 2/2008 Krengel ..... A47F 5/0892 254/338
7,527,242 B2 * 5/2009 Shaha ..... E04H 6/42 254/338
7,740,143 B2 * 6/2010 White ..... A63B 71/0045 211/85.7
8,056,883 B1 * 11/2011 Brockie ..... B66D 3/04 254/338
8,162,159 B2 * 4/2012 Carter ..... A47B 46/005 211/117
8,371,458 B2 * 2/2013 Yu ..... A47F 5/0892 52/39
9,226,575 B2 * 1/2016 Crowley ..... A47B 43/003
9,629,455 B2 * 4/2017 Shah ..... A47B 47/0083
9,669,907 B2 * 6/2017 Field ..... B63B 32/83
9,737,136 B1 * 8/2017 Toland ..... G02B 27/021
9,737,140 B2 * 8/2017 Bondi ..... A47B 43/006
11,060,789 B2 * 7/2021 Beck ..... F25D 25/024
11,382,422 B1 * 7/2022 Gatski ..... A47F 5/0892
2003/0164347 A1 * 9/2003 Bouvier, Jr. ..... B63B 32/83 211/187
2006/0266905 A1 * 11/2006 Becke ..... F25D 25/021 248/302
2007/0029267 A1 * 2/2007 Hall ..... B62H 3/12 211/175
2009/0058240 A1 * 3/2009 Stuwe ..... A47B 51/00 312/248
2009/0278004 A1 * 11/2009 Eustace ..... A47B 43/003 248/201
2012/0061544 A1 * 3/2012 Boda ..... B66F 7/02 254/338
2012/0181240 A1 * 7/2012 Crowley ..... A47B 43/003 211/117
2013/0084158 A1 * 4/2013 Evans ..... B63C 15/00 414/800
2013/0320180 A1 * 12/2013 Castellanos ..... A47B 96/06 248/223.41
2014/0001133 A1 * 1/2014 Shaghafi ..... A47B 81/005 211/85.7
2015/0272323 A1 * 10/2015 Klooth ..... A47B 96/07 182/144

* cited by examiner

STORAGE SYSTEM WITH UNDER PLATFORM STORAGE

TECHNICAL FIELD

This invention relates to storage systems, and more specifically to hanging storage systems that raise and lower.

BACKGROUND

There are many methods for storing items. One method is storing items on platforms where the platforms are not directly supported by the ground below the platform. Such storage platforms enable the storage of items at heights while leaving space underneath the platform for other items or activities. Such platforms can be high enough for a person to walk under, which adds the benefit of making the space underneath the platform usable for foot traffic. A drawback to this is the items can be hard to access from ground level. One technology that can be integrated into platform storage systems is mechanisms which raise and lower the platform, simultaneously making it easier to access the platform from ground level and allowing more space under the platform while items are being stored.

Some items do not lend themselves to being stored on a platform. For example, some items are an unusual shape such as being long or rounded. Thus, when placed on a flat surface for storage, they prevent efficient storage of other items. Various alternatives exist for storing such items, such as laying them on the floor near a wall, leaning them against a wall, and suspending them from hooks screwed into a wall.

SUMMARY

In a first aspect, the disclosure provides a storage system, having a rectangular platform adapted to be raised and lowered. The platform includes a top surface configured to support one or more items to be stored, a bottom surface, a first side, and a second side opposite the first side. The system also includes a first bracket, with an upper portion attached to the first side of the platform and a lower portion extending below the bottom surface. The lower portion of this first bracket is shaped in such a way as to provide a first surface on which a portion of an additional item rests. The system also includes a second bracket, likewise with an upper portion attached to the second side of the platform and a lower portion extending below the bottom surface. The lower portion of the second bracket is also shaped in such a way as to provide a second surface on which a portion of the additional item rests. In this way, the first and second brackets cooperate to support the additional item below the platform.

In a second aspect, the disclosure provides a storage system, with a rectangular platform adapted to be raised and lowered, and having a top surface configured to support one or more items to be stored, a bottom surface, a first side, and a second side opposite the first side. The system also includes a first generally planar I-shaped bracket, the upper portion of which forms the top horizontal bar of the I. This upper portion is attached to the first side of the platform. The first bracket also includes a lower portion, with the lower portion forming the vertical bar of the I, extending below the platform. The lower portion also forms the bottom horizontal bar of the I. As such, a first surface is provided for supporting a first additional item and a second surface is provided for supporting a second additional item. The system includes a second similarly shaped bracket, thus providing a third surface for supporting the first additional item and a fourth surface for supporting the second additional item. As such, the first and second brackets cooperate to support the first and second additional items below the platform.

In a third aspect, the disclosure provides a storage system, with a rectangular platform adapted to be raised and lowered, the platform having a top surface configured to support one or more items to be stored, a bottom surface, a first side, and a second side opposite the first side. The system also includes a bracket, having an upper portion attached to the first side of the platform and a lower portion extending below the bottom surface, and wherein the lower portion is shaped in such a way as to provide a first surface on which a first portion of an additional item rests. Also included in the system is at least one clip that is attached to the platform and extends below the bottom surface of the platform. This at least one clip is configured to releasably hold a second portion of the additional item. As such, the first bracket and the at least one clip cooperate to support the additional item below the platform.

Further aspects and embodiments are provided in the foregoing drawings, detailed description, and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
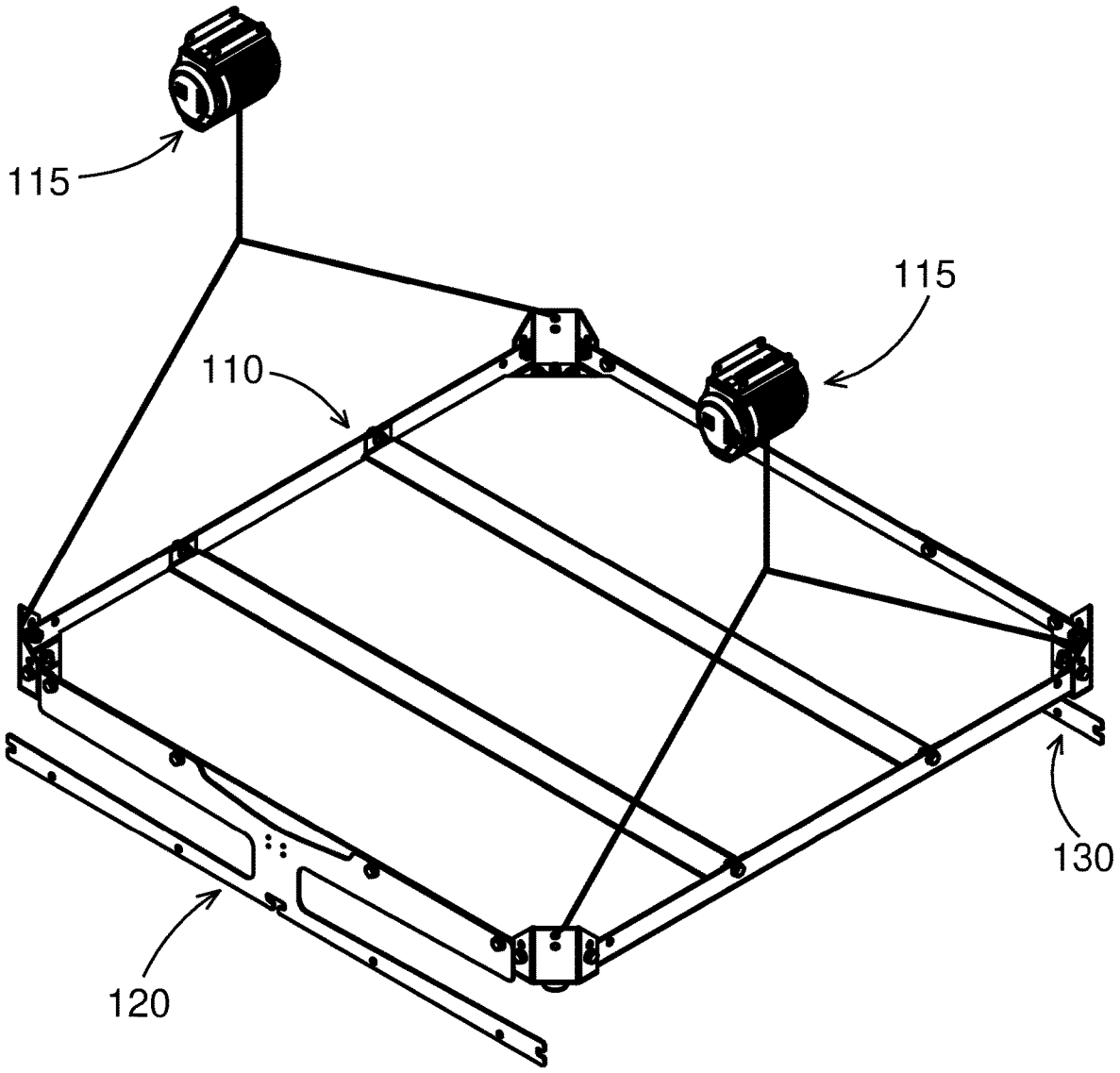
FIG. 1 is an isometric view from above of one embodiment of the invention.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "bracket" is meant to refer to a means of holding something in position relative to a supporting structure. An example of a bracket is a piece of wood or sheet metal that bolts to a structure and provides one or more surface upon which an object may rest. Another example of a bracket is a piece of metal welded to a support structure that provides one or more surface upon which an object may rest.

As used herein, "generally planar" is mean to refer to an item that is at least mostly flat. For example, such a shape for a generally planar bracket could be obtained by cutting the bracket from a flat piece of metal.

As used herein, "mechanically integral" is meant to refer to a feature of a part that is mechanically continuous with or fused to the part. An example of this is a bracket formed from sheet metal by cutting the bracket profile in the sheet metal. A derivative example from the first example adds the additional step of bending the part so the bracket is on a different plane from the surrounding portion of sheet metal. Another example of mechanically integral is a plate with mounting holes welded onto a structural member such as an angle or an I-beam. A mechanically integral feature may also be defined as a feature that cannot be separated from a part without cutting or melting the part itself.

As used herein, the verb "bolt" is meant to be synonymous with "fasten" and refers to the act of using a fastener to attach a part to one or more part. A bolt is a common type of fastener, but there are additional ways to fasten, including using a rivet, using a retaining pin, using an adhesive, and using a press-in fastener. Often, fasteners are separate from the part being bolted, but fasteners can also be built into the part, such as a protruding clip (which use the principles of compliant mechanisms as part of the act of fastening), a retaining pin that is formed as a feature of the part, or a protruding feature designed to press fit into a receiving hole or opening.

The present invention relates to a storage platform that raises and lowers and one or more brackets that attach to the platform which provide additional storage below the platform.

Preferably, the platform is configured to raise and lower to facilitate access and move items to a storage position in space that is less intrusive. More preferably, the platform height is positioned by an automatic mechanism such as a winch. More preferably, the platform is suspended from and height adjusted by MyLifter products.

Preferably, the platform has a generally planar or flat, horizontal surface for storing items. More preferably, the perimeter of the platform is rectangular. Still more preferably, the platform is approximately 3 feet wide and 3 feet long. More preferably, the platform is that which is a part of the SmartHome line of storage platforms. Alternatively, the platform can have non-flat and/or non-horizontal surfaces for storing items. Alternatively, the shape of the platform is non-rectangular with sections of the perimeter being flat. Alternatively, the shape of the perimeter of the platform can be any shape that is fitting for the application, with or without sections that are flat.

Preferably, the sides of the platform have a vertical member that creates a lip around the perimeter of the platform. More preferably, the sides are made from metal angle rising at least ⅞" above the storage surface of the platform. More preferably, the sides have holes through which a bolt can pass, thus allowing the platform to be assembled with bolts and nuts. More preferably, there are more holes in the side of the platform than are needed for platform assembly.

Preferably, each bracket is configured with an upper portion that attaches to the side of the platform and a lower portion that hangs below the platform and facilitates the storage of additional items from and below the platform. A wide variety of brackets may be desirable. The selection of the bracket design will depend on the intended application. More preferably, a bracket is paired with a bracket on an opposing side of the platform to facilitate storage of items using both brackets. In one preferred embodiment, a pair of brackets is configured to store yard or garden tools with long handles such as push brooms, shovels, pole saws, weed eaters, rakes, and hoes. In another preferred embodiment, a pair of brackets is configured to store outdoor equipment such as snowboards, skies, longboards, wakeboards, volleyball standards, paddle oars, and various poles such as ski poles and fishing poles.

In one preferred embodiment, a bracket is generally planar or flat and has at least one profile that creates a storage surface on a lower portion of the bracket. An item being stored under the platform can rest on this surface. In one preferred embodiment, the 2-dimensional cross section across the bracket's thickness is constant save for minor differences such as threading holes, draft angle from manufacturing, and chamfering sharp edges.

A bracket can have multiple profiles that each create their own storage surface. There are many different profile designs which may be desirable. The design of the profile will be selected based on the application. In a preferred embodiment, a profile creates a storage surface which is a stationary, substantially upward facing surface upon which an item to be stored can rest. Examples surfaces include: a flat, generally horizontal surface, a concave up half circle, a convex up arc, arcs with changing radii, a notch, other complex shapes derived from a profile with one or more inflection point between flat and/or curved lines. Lengths, radii, and other dimensions will be selected based on specific applications and may be modified to make the surface more universal to additional applications. For example, an upward facing horizontal storage surface might be chosen for many items while a concave-up or convex-up storage surface might be chosen for other items, such as items that are susceptible to rolling or rocking. In an alternative embodiment, one or more storage surface may be part of a storage mechanism that grabs or otherwise holds an item with forces in addition to the force of the item resting on the storage surface, such as a downward facing clip mechanism that is mechanically integral in the bracket as a compliant mechanism. In one preferred embodiment, rope, straps, bungie cords, elastic cords, gates, clamps, or other restraining means additionally help prevent the item being stored from accidentally dislodging from storage.

Preferably, one or two brackets attach to one side of a platform and one or two bracket attach to an opposing side of the platform. In an alternative embodiment, one or two bracket attach to one side of the platform and one or more clip are attached to the bottom of the platform substantially opposite the side of the platform with brackets.

Alternatively, more than two brackets attach to a side of the platform.

Alternatively, each bracket is mechanically part of the side of the platform such as being formed from metal that comprises a side or welded to the metal that comprises a side.

There are many ways to attach a bracket to the platform. The method chosen will depend on the particular application. In one preferred embodiment, each bracket is attached to the platform by bolts, nuts, and washers. In another preferred embodiment, each bracket hooks onto a side of the platform. More preferably, in addition to hooking on the platform, an additional means of securing the bracket to the platform is used, such as an adhesive or a set screw. In other preferred embodiments, each bracket attaches via a combination of bolts, pins, hooks, screws, push in fasteners, and/or compliant features. Regardless of the method of attachment, preferably, the method does not interfere with the storage of items on top of the platform.

Preferably, the upper portion of the bracket corresponds to the side of the platform where it attaches. More preferably, the bracket is cut from a piece of sheet metal. In one preferred embodiment, the upper portion has holes that correspond to the holes in a side of the platform so bolts or a similar fastener can be used to attach the bracket. In another preferred embodiment, the bracket has one or more hooks from which the bracket hangs from the side of the platform. More preferably, the bracket also has an additional means of securing the bracket different from a hook, such as a set screw which screws into the bracket and presses against the underside of the platform.

In one preferred embodiment, the bracket is configured so additional brackets or other items can mount to the bracket. More preferably, the lower portion of the bracket has additional mounting holes for mounting additional brackets below the platform. Still more preferably, an additional bracket mounts below any storage surfaces on and near the bottom of the initial bracket. More preferably, multiple brackets can be attached to brackets in this way.

Preferably, the bracket is cut from a piece of sheet metal or plate. More preferably, the sheet or plate is cut using a 2-dimensional cutting process such as computer-controlled laser cutting or computer-controlled water jet cutting. Alternatively, the main structural element of the bracket is made from a rigid material such as plastic, wood, or ceramic.

In one preferred embodiment, each storage surface has non-slip and/or softening characteristics—the latter to prevent scratching items being stored on the brackets. More preferably, the storage surface is rubber dipped or has otherwise had rubber applied to it, such as applying a "U" shaped piece of rubber to the storage surface. In one preferred embodiment, the application of rubber to the storage surface allows for the rubber to be bonded to the bracket, such as the rubber attaching itself to the bracket—like in a rubber dipping process—or by use of an adhesive. Alternatively, the application of the rubber may be through friction such as a press-fit application.

More preferably, in the case where pre-formed, "U" shaped rubber is applied to the storage surface, the distance between the opposing surfaces inside the "U" after it has been applied to the bracket is approximately the thickness of the material comprising the bracket to allow for contact of the bracket with said surfaces of the rubber. Alternatively, there may be additional distance between the opposing surfaces inside the "U".

Alternatively, the non-slip and/or softening characteristic is achieved through painting, powder coating, or the application of another coating.

Now referring to FIG. 1, one embodiment of the invention is shown with platform 110, platform winches 115 which raise and lower platform 110, and bracket 120. As shown, the bracket 120 is I-shaped, with the top bar of the I being attached to the platform. The lower portion of the bracket includes the vertical bar of the I and the horizontal lower bar of the I. In this way, the lower bar forms two surfaces on which to support addition items, i.e. one on each side of the center.

This geometry can also be though of as the supporting surface being the bottom of a C-shaped opening. In the depicted embodiment, there are two C-shaped on each bracket, which corresponding openings on the first and second brackets opening in the same direction.

Winches 115 are attached to a structure and raise or lower the platform by taking in or letting out the lines supporting platform 110. Suitable winch include those described in U.S. Pat. No. 9,624,076, entitled "Synchronized Motorized Lifting Devices for Lifting Shared Loads," the entire disclosure of which is incorporated herein by reference.

FIG. 1 also shows bracket 130 attached to a side of platform 110 opposing where bracket 120 is attached. Brackets 120 and 130 do not have to be any specific design other than their upper portions being attached to the platform and their lower portions being configured to store one or more item below the platform. In this embodiment depicted in FIGS. 1 and 2, the brackets are interchangeable with other brackets and each bracket can individually be changed for a bracket that attaches to the platform differently and/or has a different storage configuration.

Figure 2:
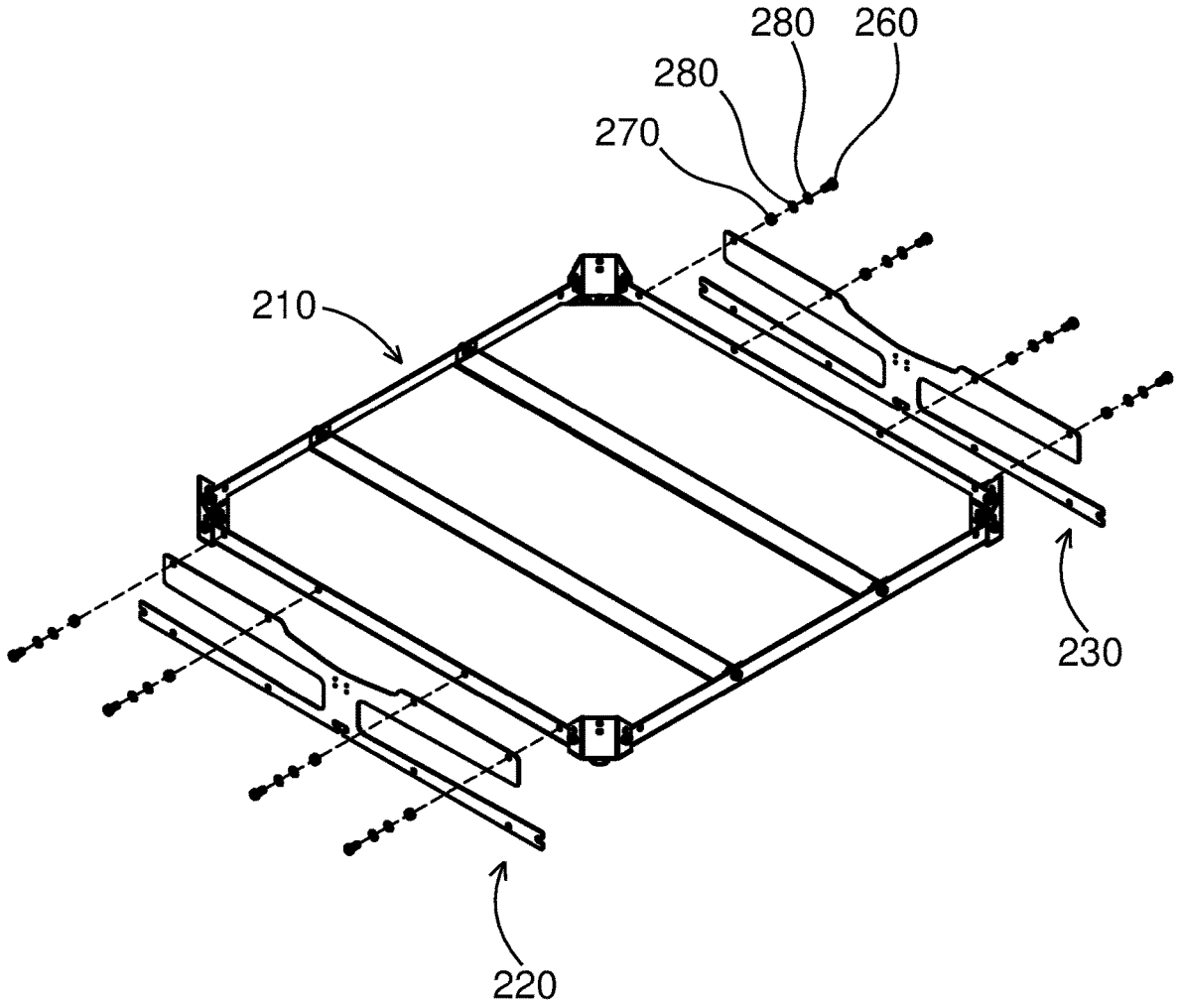
FIG. 2 is an exploded view of one embodiment of the invention.

FIG. 2 shows an exploded view, wherein brackets 220 and 230 are each attached to platform 210 by multiple bolted connections comprising bolt 260, nut 270, and two washers 280. In this embodiment, the bolts pass through holes in the upper portions of brackets 220 and 230 and through correspond to holes in opposing sides of platform 210. In this embodiment, 4 bolts, 4 nuts and 8 washers are used per bracket. Preferably, bolt 260, nut 270, and washer 280 are selected from a catalog of readily available, mass produced stock. In alternative embodiments, more of each could be used or as few as 1 bolt could be used and the nut could be replaced by female threads in something else, such as a rivet nut which attaches to the platform or threads directly into threads machined into the sides of the platform. In alternative embodiments, one or more bolted connection could be replaced by one of the numerous other different types of fasteners, such as a shoulder screw, retaining pin, or press-fit or press-in fastener.

Figure 3:
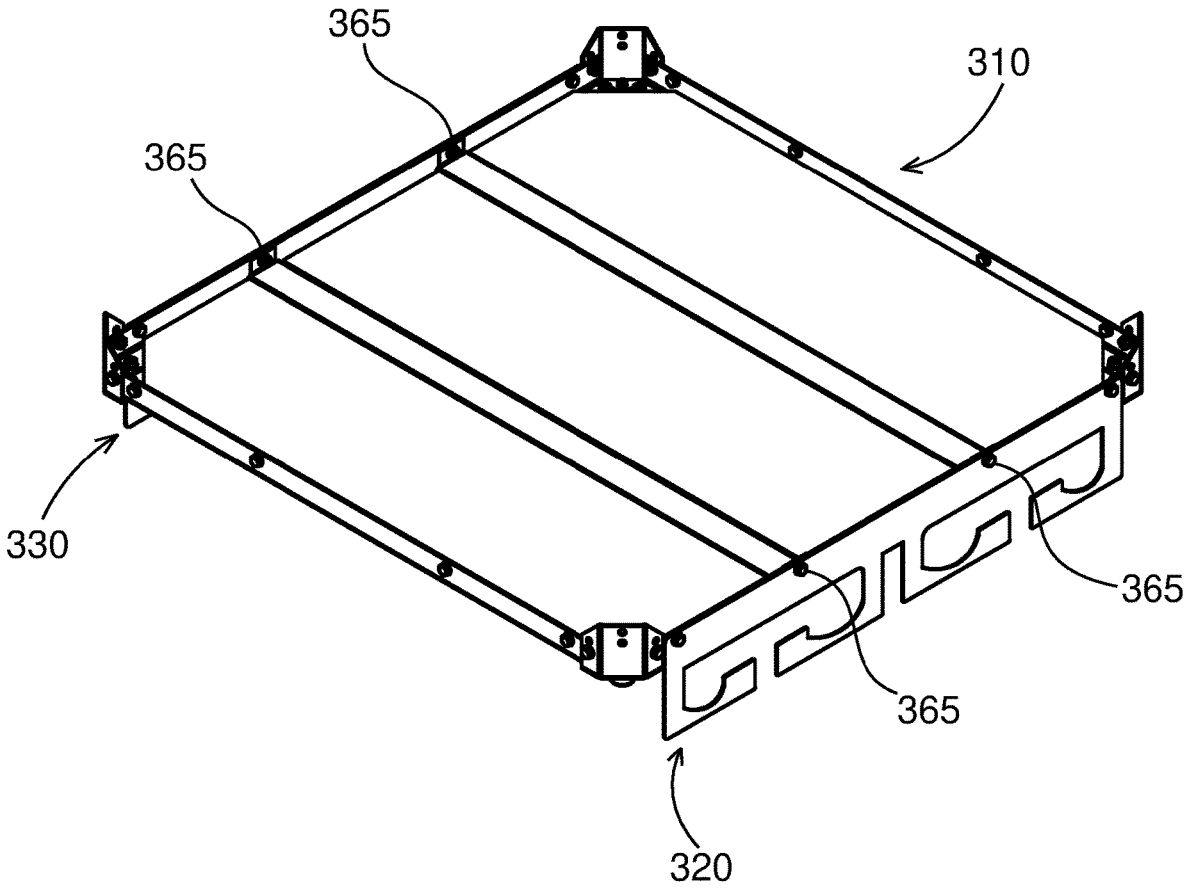
FIG. 3 is an isometric view from above of one embodiment of the invention.

FIG. 3 shows brackets 320 and 330 attached to platform 310. There are 2 items of particular note about FIG. 3. First, in addition to bolted connections 365 attaching brackets 320 and 330 to platform 310, bolted connections 365 are also part of the assembly of platform 310 and are integral to the structural integrity of platform 310. Second, brackets 320 and 330 have a different storage configuration from that found in some of the other figures. In these brackets, the supporting surfaces are concave.

Figure 4:
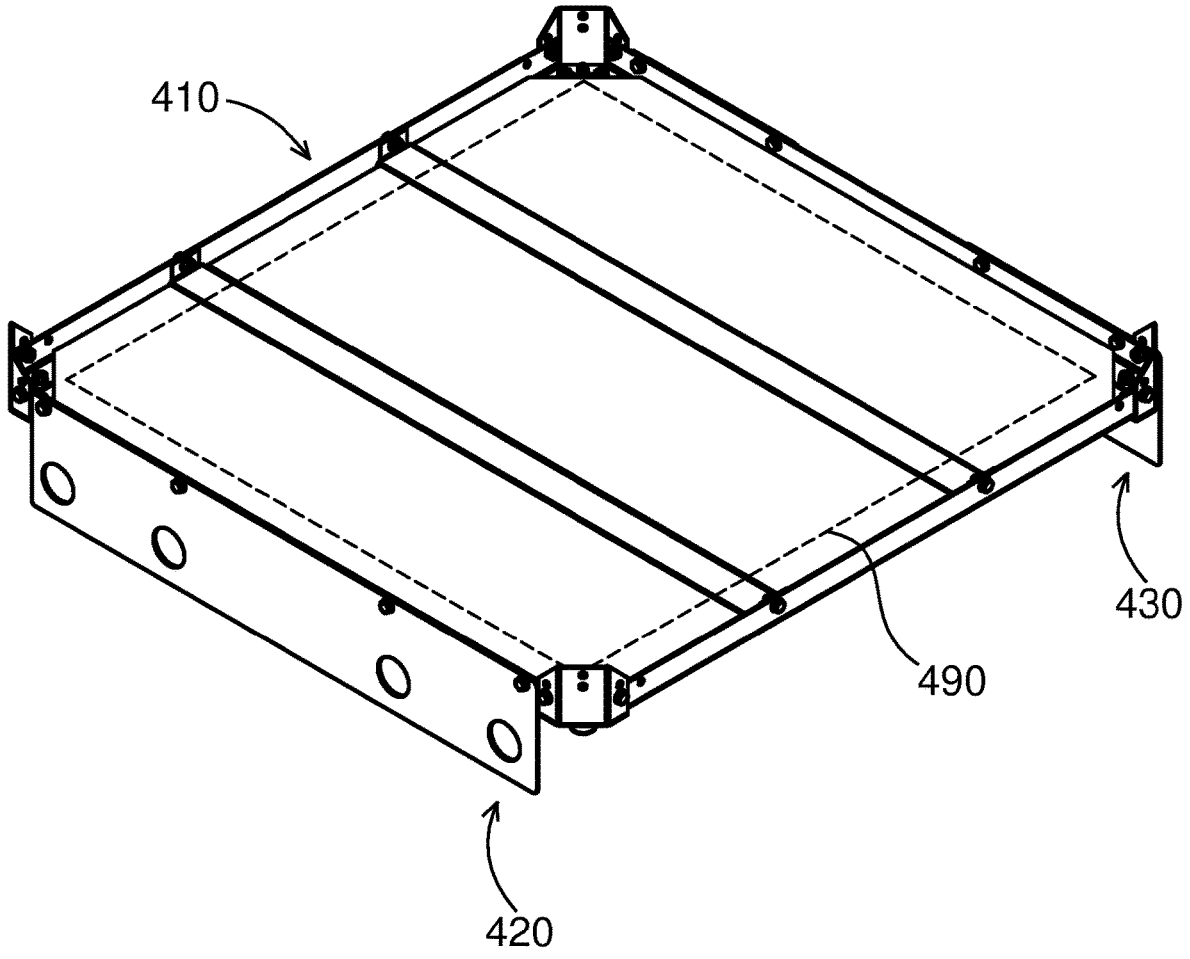
FIG. 4 is an isometric view from above of one embodiment of the invention.

FIG. 4 shows brackets 420 and 430 attached to platform 410. There are 2 items of particular note about FIG. 4. First, the top surface of platform 410 shows storage area 490 enclosed by a perimeter represented by a dashed line. In one preferred embodiment, once the brackets are attached to the platform, the attachment method used to attach the brackets does not enter the volume of space above the storage area. Second, brackets 420 and 430 have a different storage configuration from that found in some of the other figures. Bracket 420 has four concave supporting that each form the bottom of a circular hole. Such holes are useful to capture rod-like structures, such as the end of a shovel or rake handle.

Figure 5:
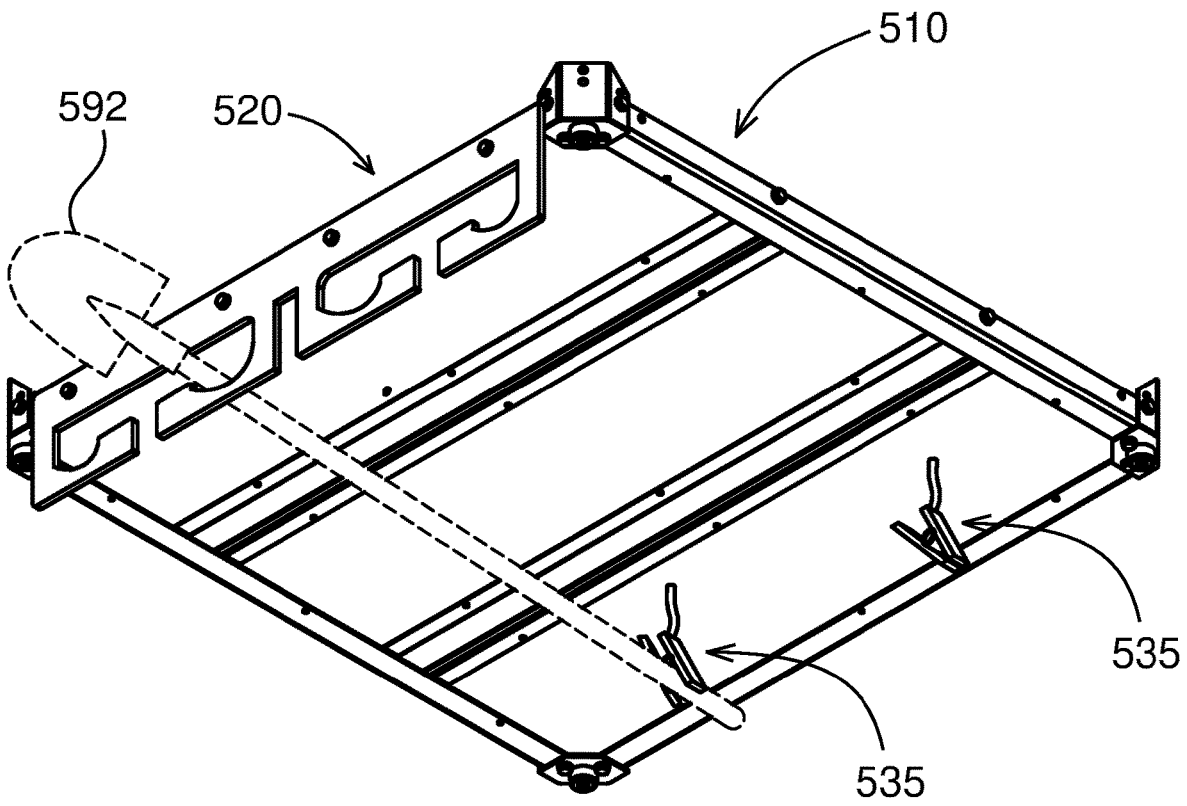
FIG. 5 is an isometric view from below of one embodiment of the invention. It also depicts an example of an item that may be used with the invention.

FIG. 5 shows a preferred embodiment with bracket 520 attached to one side of platform 510. Additionally, the figure show clips 535 attached to the bottom of platform 510, in the place of a second bracket. Item 592, i.e. the shovel represented by the dashed lines, is one embodiment of a garden or yard tool that could be stored under the platform. Bracket 520 and clip 535 cooperate to store item 592. Note that a portion of item 592 extends beyond the space directly underneath the platform; it is acceptable and even expected for an item being stored under the platform to extend beyond the space directly below the platform.

Figure 6:
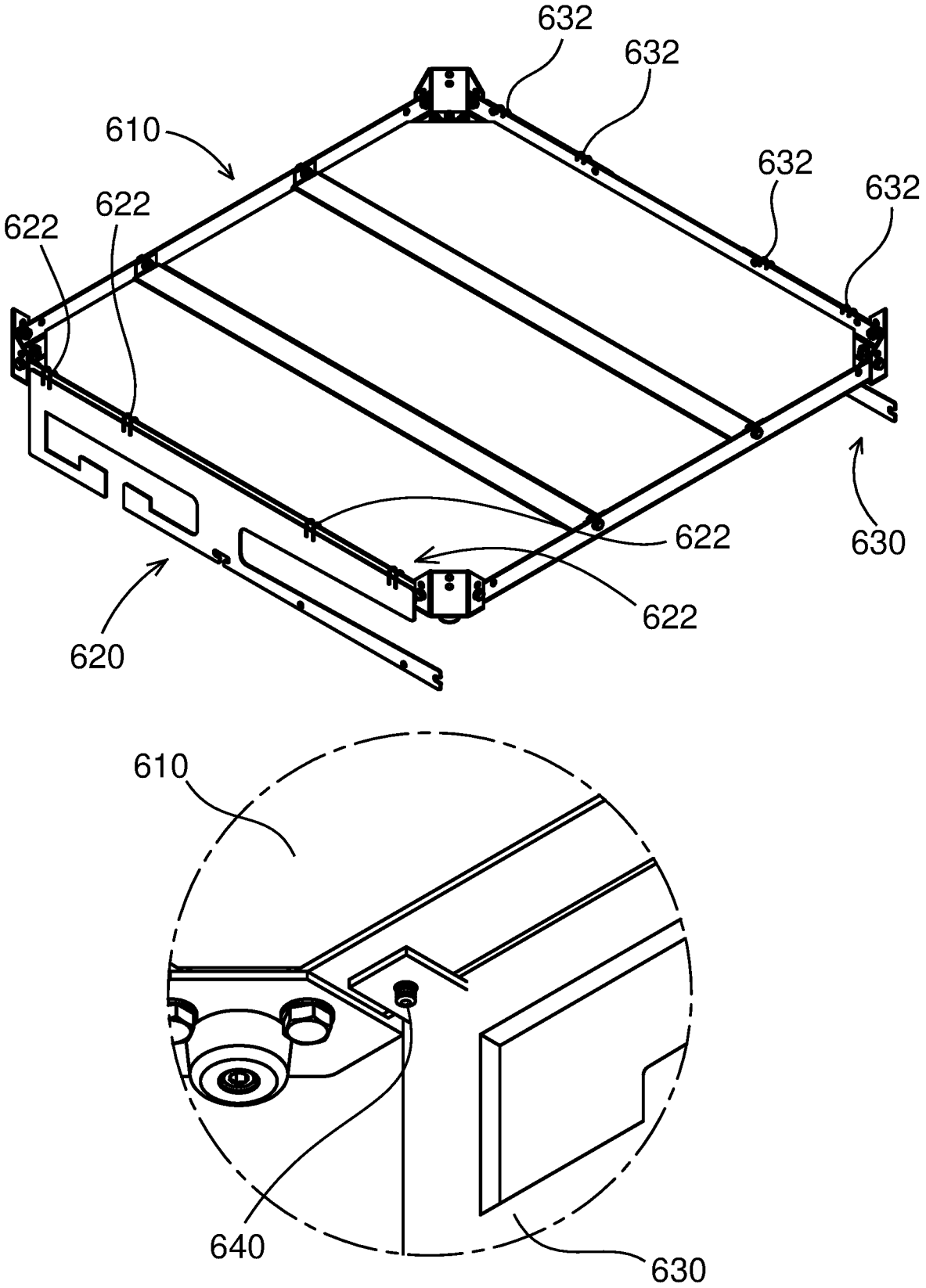
FIG. 6 is an isometric view from above and a detailed view from below of one embodiment of the invention.

The isometric view from above in FIG. 6 shows brackets 620 and 630 hooked onto platform 610 via their respective hooks 622 and 632. This figure shows 4 hooks per bracket, but the number of hooks can also be one, two, three, or more than 4. The determination of the number and size of hooks will be selected per the application. Additionally, the detailed view (from below the platform) shows bracket 630 being additionally secured to platform 610 by set screw 640. Alternatively, the set screw can be replaced with another fastener such as a bolt or adhesive.

Also, note that bracket 620 has multiple configurations of storage surfaces from differing profiles.

Figure 7:
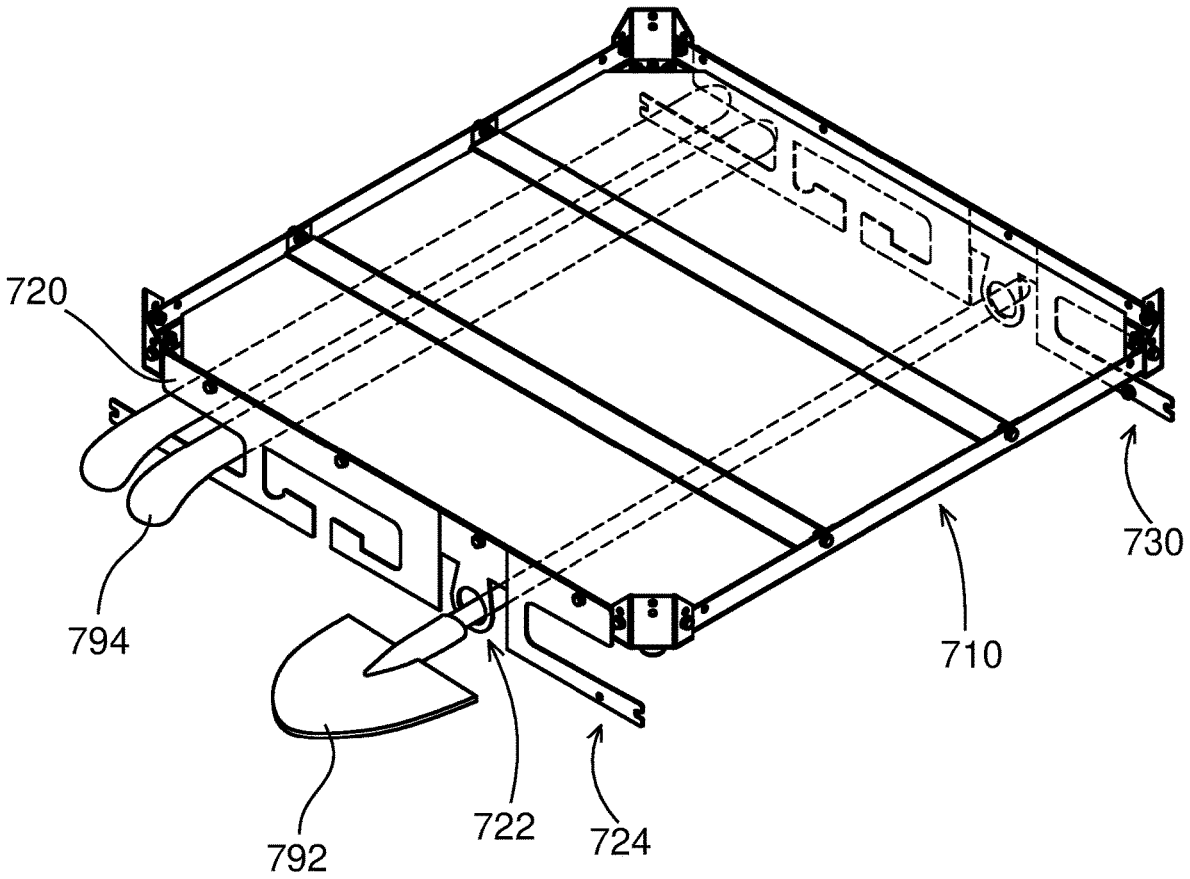
FIG. 7 is an isometric view from above of one embodiment of the invention. It also depicts examples of items that may be used with the invention.

FIG. 7 shows a preferred embodiment of platform 710 with brackets 720, 722, and 724 attached to one side of the platform and bracket 730 attached to an opposing side of the platform. While three brackets are shown on one side, the intent is to show that more than one bracket can be attached to the same side, so two, three, or more brackets are all acceptable configurations. The number of brackets selected will depend on the application.

Bracket 724 has a nearly horizontal storage surface. More preferably, this surface slopes down away from the opening and toward the portion of the bracket that connects it to the upper portion of the bracket.

Bracket 722 has a circular hole. The resultant storage surface is cylindrical.

Bracket 720 has multiple profile and surface configurations, including a flat surface similar to of bracket 724, a half circle, and a hybrid profile shaped like a block letter "U".

Additionally, FIG. 7 depicts bracket 722 supporting item 792; item 792 generically is a garden or yard tool. It also depicts bracket 720 supporting item 794; item 794 generically is an item of outdoor equipment. In alternative embodiments, items 792 and 794 could be from a wide variety of items that can be supported by the respective storage surfaces they are resting on. In fact, given the diversity of items and sub-structures generally available, it would be impractical, if not impossible, to compile a list of what can be supported by a given storage surface or bracket.

Figure 8:
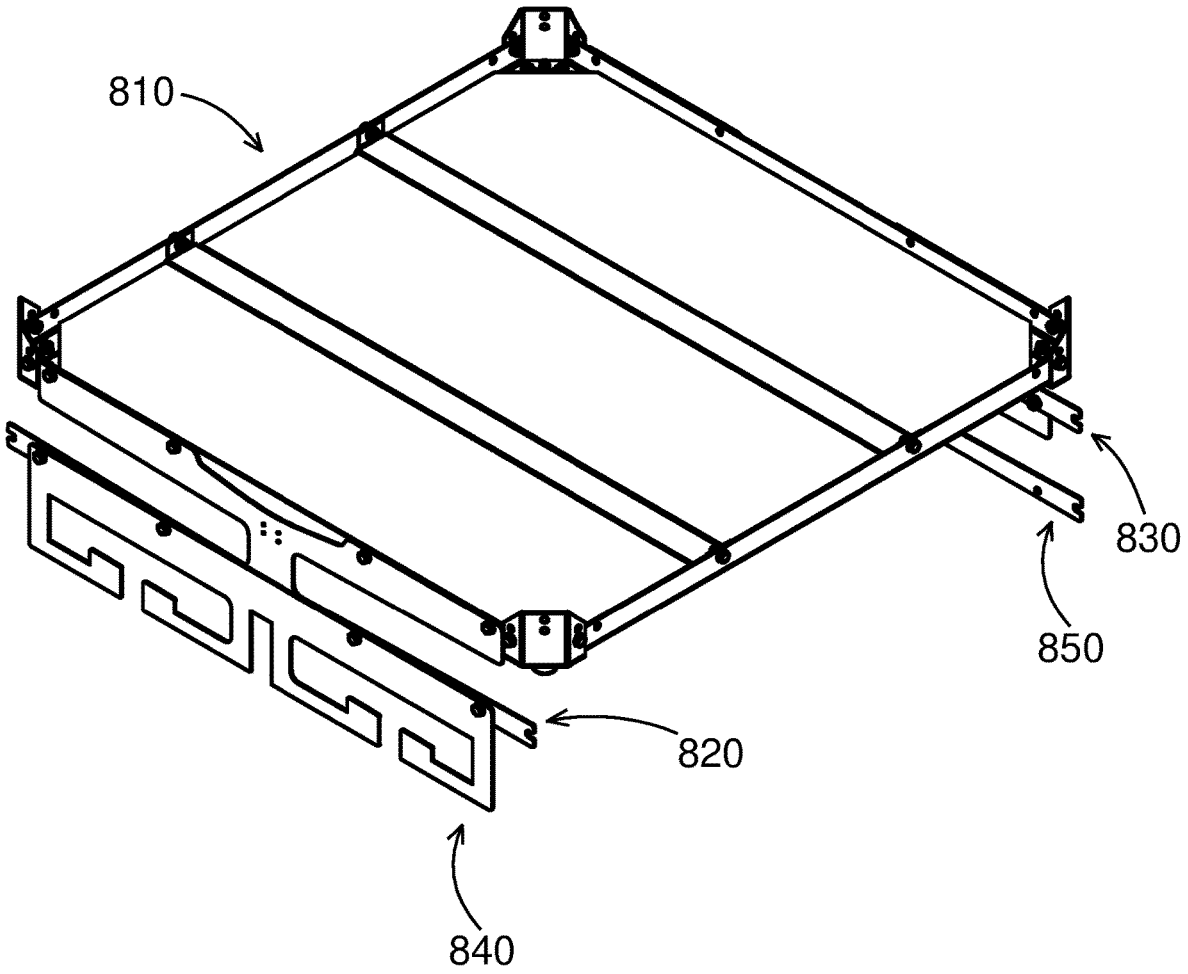
FIG. 8 is an isometric view from above of one embodiment of the invention.

FIG. 8 depicts brackets 820 and 830 attached to opposing sides of platform 810. Additionally, FIG. 8 depicts a secondary bracket 840 attached to the lower portion of bracket 820 and secondary bracket 850 attached to the lower portion of bracket 830. A couple of things are especially noteworthy. First bracket 840 is different from bracket 820. It is acceptable for differing brackets to be used together this way. Second another bracket can be mounted to the lower portion of bracket 850. A long chain of bracket mounting to bracket is acceptable so long as the structures involved in supporting all of the brackets and platform can withstand the accompanying forces. Preferably, this principle of the brackets, platform, and exterior structure being able to support the brackets and platform is applicable across all embodiments and configurations. In FIG. 8, bolted connections are used to attach one bracket to another. Other embodiments can attach in other ways, such as with hooks or adhesive. In another embodiment, the same storage configuration can be achieved by cutting the profiles into one piece of material or welding 2 or more brackets together.

Figure 9:
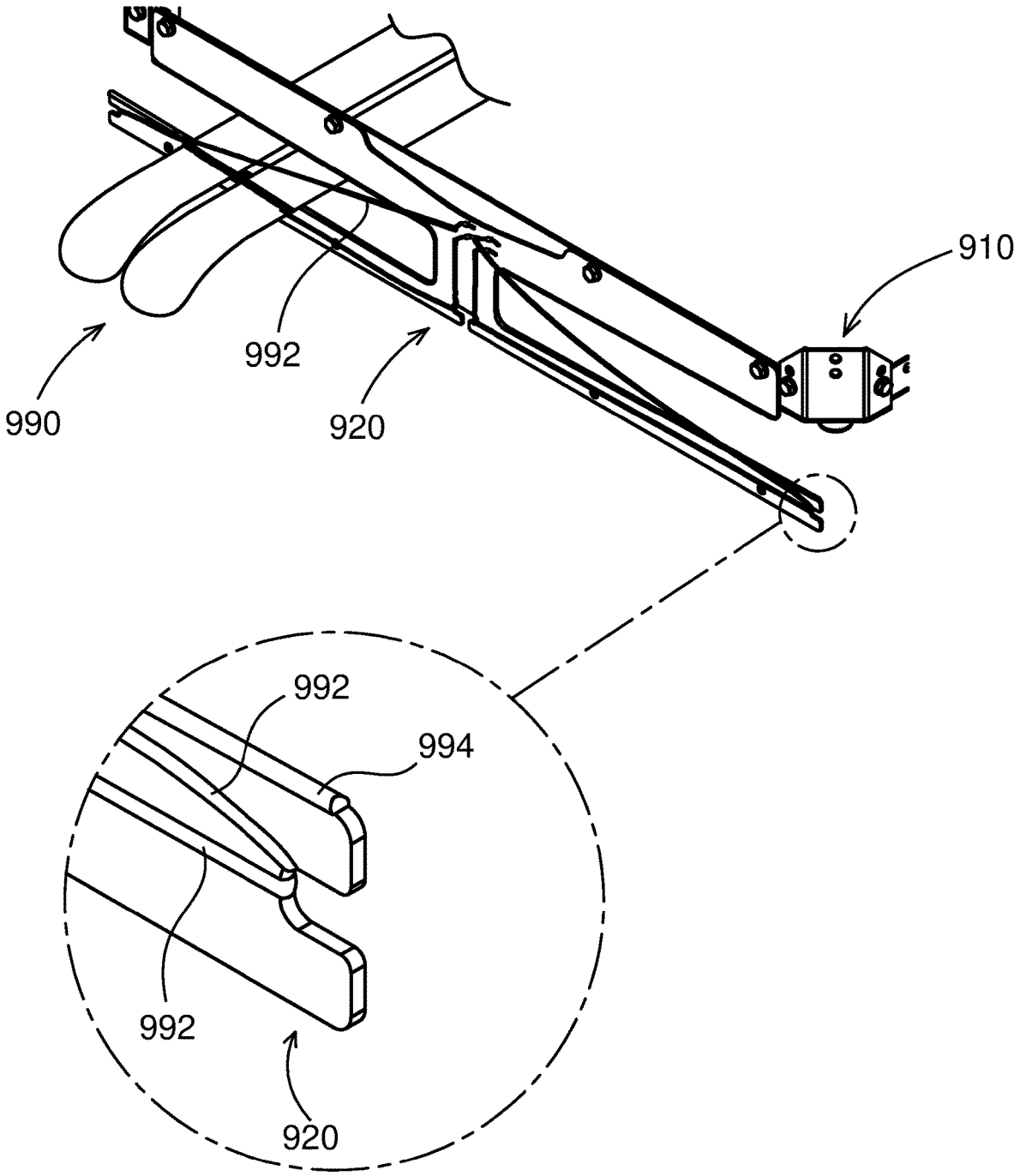
FIG. 9 is a partial isometric view from above of one embodiment of the invention. It also depicts an example of an item that may be used with the invention.

FIG. 9 depicts bracket 920 attached to a side of platform 910. Item 990 is being supported by bracket 920. Additionally, cord 992, such as an elastic cord, is attached to bracket 920 and further secures item 990 to bracket 920. Material 994 depicts the addition of a non-slip and/or softening material to bracket 920. Other embodiments will have a different visual characteristic as well as differing non-slip and/or softening characteristic. Each of these characteristics will be selected based on the desired application.

Figure 10:
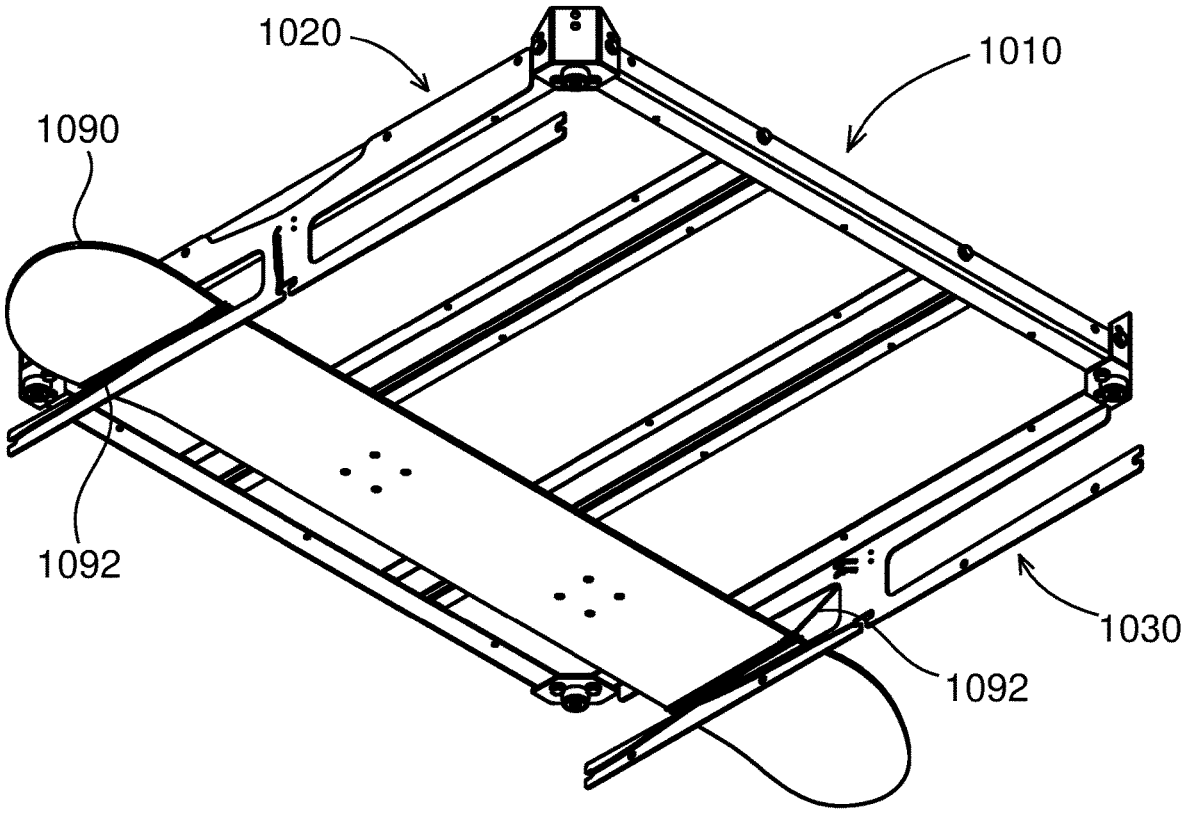
FIG. 10 is an isometric view from below of one embodiment of the invention. It also depicts an example of an item that may be used with the invention.

FIG. 10 depicts brackets 1020 and 1030 attached to opposing sides of platform 1010. Item 1090 is being supported by brackets 1020 and 1030. Cords 1092 is additionally securing item 1090 to brackets 1020 and 1030. Of particular note, cord 1092 is securing item 1090 to the brackets in different ways. There are many effective configurations of a cord on a bracket. The configuration of the cord is selected per the application.

Figure 11:
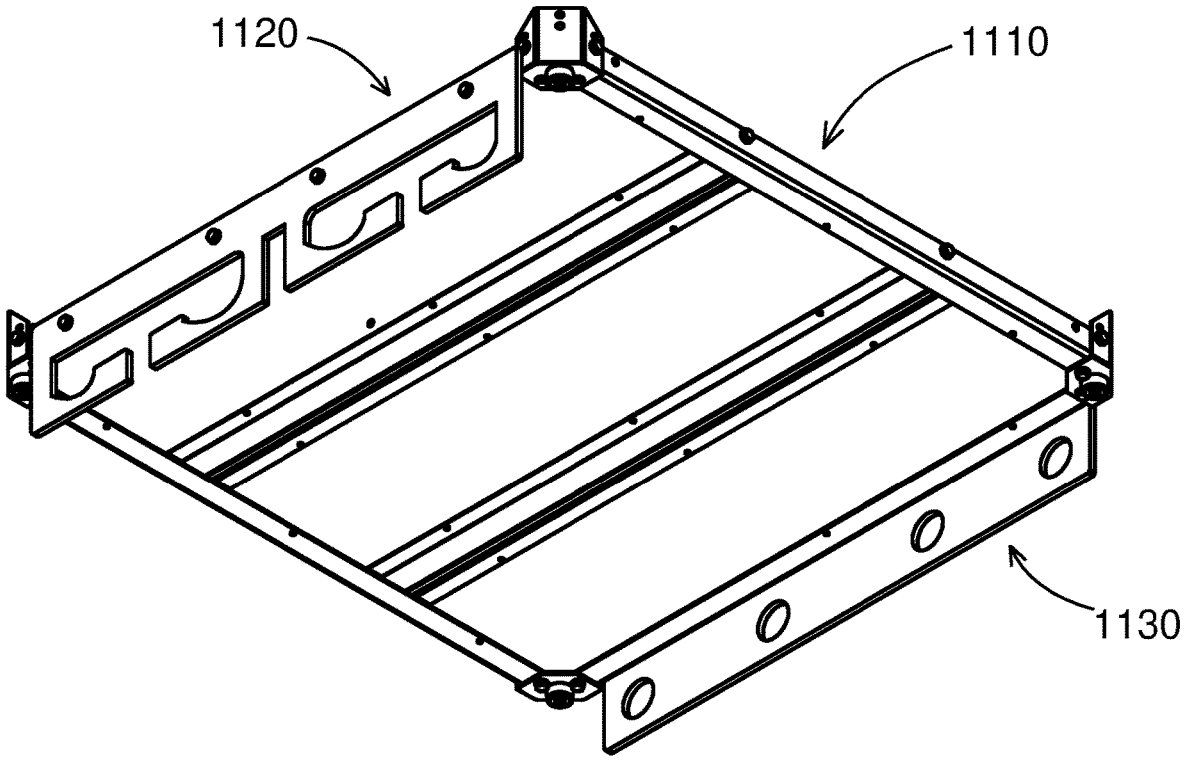
FIG. 11 is an isometric view from below of one embodiment of the invention.

FIG. 11 depicts brackets 1120 and 1130 attached to opposing sides of platform 1110. Of particular note in this figure, the storage surfaces of bracket 1120 are different from those of bracket 1130. In particular, the holes in bracket 1130 can support the end of a rod-shaped item, such as a shove or rake handle, with the end being inserted through the hole. The openings in bracket 1120 can be used to support the other "business end" of the shove or rake.

While the above figures generally depict a bracket on one side of a platform and another bracket on an opposing side of the platform, alternative embodiments may have brackets on any side of the platform. These brackets may individually store items under the platform and/or may cooperate with other brackets to store items under the platform.

The invention has been described with reference to various specific and preferred embodiments and techniques. Nevertheless, it is understood that many variations and modifications may be made while remaining within the spirit and scope of the invention.

What is claimed is:

1. A storage system, comprising:

a rectangular platform adapted to be raised and lowered, the platform comprising a top surface configured to support one or more items to be stored, a bottom surface, a first side, and a second side opposite the first side;

a first bracket, comprising an upper portion attached to the first side of the platform and a lower portion extending below the bottom surface, and wherein the lower portion is shaped in such a way as to provide a first surface on which a portion of an additional item rests; and a second bracket, comprising an upper portion attached to the second side of the platform and a lower portion extending below the bottom surface, and wherein the lower portion is shaped in such a way as to provide a second surface on which a portion of the additional item rests;

wherein the first and second brackets cooperate to support the additional item below the platform wherein the first bracket and second bracket are formed from a planar sheet;

wherein the upper portions of the first and second brackets do not extend above the top surface of the platform;

wherein the lower portion of the first bracket is shaped in such a way as to provide a second surface on which a portion of a second additional item rests, the lower portion of the second bracket is shaped in such a way as to provide a second opposing surface on which a portion of the second additional item rests, and the first and second brackets cooperate to support the second additional item below the platform; and a coating on the first surface and the second surface to reduce scratching of additional items resting thereon.

2. The system of claim 1, wherein the platform is supported by lines adapted to move the height of the platform, so that the platform can be raised to a storage position and lowered to facilitate access.

3. The system of claim 1, wherein the coating is polymeric.

4. The system of claim 1, wherein the first surface and second surface are concave to thereby hold an additional item with a rod-shaped portion.

5. The system of claim 4, wherein the additional item is a garden tool with a rod-shaped handle.

6. The system of claim 4, wherein the additional item is a piece of sporting equipment.

7. The system of claim 4, wherein the first bracket is shaped so that the first surface has an opening above it and the second bracket is shaped so that the second surface has an opening above it.

8. The system of claim 4, wherein the first bracket is shaped so that the first surface has an opening above it and wherein the second bracket is shaped so that the second surface is the bottom part of a round hole in the second bracket.

9. The system of claim 8, wherein the additional item is a garden tool with a rod-shaped handle, and wherein an end of the handle is inserted through the round hole in the second bracket.

10. The system of claim 1, wherein the first surface and second surface are the bottom surface of a C-shaped opening in the first bracket and second bracket respective, and wherein the C-shaped opening on each of the first and second bracket are open toward the same side.

11. The system of claim 1, wherein the first and second brackets further comprise elastic cord to hold the additional item to the brackets.

* * * * *